US011311790B2

(12) United States Patent
Ei

(10) Patent No.: US 11,311,790 B2
(45) Date of Patent: Apr. 26, 2022

(54) COMPRESSION GOLF SWING TRAINING APPARATUS

(71) Applicant: Jeffrey Ei, Overland Park, KS (US)

(72) Inventor: Jeffrey Ei, Overland Park, KS (US)

( * ) Notice: Subject to any disclaimer, the term of this patent is extended or adjusted under 35 U.S.C. 154(b) by 0 days.

(21) Appl. No.: 17/381,808

(22) Filed: Jul. 21, 2021

(65) Prior Publication Data

US 2022/0032154 A1 Feb. 3, 2022

Related U.S. Application Data

(60) Provisional application No. 63/058,499, filed on Jul. 30, 2020.

(51) Int. Cl.
*A63B 69/36* (2006.01)

(52) U.S. Cl.
CPC ..... *A63B 69/3661* (2013.01); *A63B 2209/08* (2013.01)

(58) Field of Classification Search
CPC ..... A63B 69/3661; A63B 69/3667; A63B 2209/08; A63B 2069/3664; A63B 5/00; A63B 6/00
USPC ..... 473/278
See application file for complete search history.

(56) References Cited

U.S. PATENT DOCUMENTS 3,712,628 A * 1/1973 Boss, Jr. ..... A63B 69/3661 473/279
4,955,611 A * 9/1990 Moller ..... A63B 69/3661 473/409
5,692,967 A * 12/1997 Guyer ..... A63B 69/3661 473/262
2016/0084334 A1* 3/2016 Myers ..... F16F 1/403 267/113

FOREIGN PATENT DOCUMENTS

DE 202005009845 U1 * 12/2005 ..... A63B 5/08
DE 202005009845 U1 * 1/2006 ..... A63B 5/08

OTHER PUBLICATIONS

Magg Translate, All Pages (Year: 2005).*

* cited by examiner

*Primary Examiner* — John E Simms, Jr.
*Assistant Examiner* — Rayshun K Peng
(74) *Attorney, Agent, or Firm* — Dale J. Ream

(57) ABSTRACT

A compression golf swing training apparatus includes a hitting board mounted atop a framework and configured to move downwardly at the point of impact from the golf club striking the hitting board during a golf swing. Specifically, the downward motion of the hitting board, when struck with a golf club, compresses the compression springs in their holder imitating or replicating the feeling a golfer experiences when taking a divot of golf course grass during a golf swing. The system is reconfigurable and interchangeable with distinct compression spring levels held in their individual spring holders replicating and/or imitating the resistance of the ground the golfer experiences playing on hard, soft, and wet golf course grass conditions.

14 Claims, 9 Drawing Sheets

COMPRESSION GOLF SWING TRAINING APPARATUS

REFERENCE TO RELATED APPLICATIONS

This application is related to U.S. Non-Provisional patent application Ser. No. 63/058,499 filed Jul. 30, 2020 and titled Novel Compression Based Hitting Board Component as part of a Golf Swing Training Aid Device System, the disclosure of which is incorporated herein in its entirety by reference.

BACKGROUND OF THE INVENTION

The present invention relates to golf training devices and, more particularly, to a hitting board mounted atop a compression member such that the hitting board is movable downwardly at the point of impact from a golf club striking the hitting board surface during a golf swing and is resilient to return to an uncompressed state after the impact force is removed. Compression is achieved through the use of compression springs. The device is reconfigurable and interchangeable in regard to compression levels.

In the world of golf swing training aid devices, methods, and systems, there is a seemingly endless supply of products available in the golf market place. The market place is wildly divided in regard to the overall ideal way of swinging a golf club so as to strike a golf ball. Several examples incorporate the use of attaching differing mechanisms directly to a player holding a golf club to correct faulty golf swing paths in regard to properly hitting a golf ball with a golf club. Various other examples include differently weighted or flexible devices representing a golf club so as to correct faulty golf swing paths.

One category of golf swing training aid devices employs the use of stationary artificial golf turf practice surfaces. The stationary quality of these artificial golf turf surfaces do not allow the player (the "golfer") to experience the feel of taking a divot of golf course grass. A divot, defined in golf terms, is a loose piece of grass and dirt that is dug out of the ground when the ground is struck by a golf club.

The artificial golf turf surfaces are flawed to the golfer as the golf club can bounce and skip into the golf ball upon impact of the golf club striking the stationary artificial golf turf hitting surface with regard to golf ball placement on the hitting surface. The above referenced practice surfaces produce inaccurate golf shot results. The golf marketplace has failed to provide a golf swing training aid device that features the striking of an actual golf ball via a golf club while imitating and/or replicating the feel of making a divot in the ground surface of a golf course.

Various golf swing training devices, systems, and methods for swinging a golf club and striking a golf ball are known in the art. Although presumably effective for their intended purposes, the existing devices and proposals do not provide an accurate simulation of a common occurrence of an actual golf swing, namely, experiencing making a divot in a ground surface immediately prior to or immediately after a golf club striking a golf ball.

Therefore, it would be desirable to have a golf training apparatus that simulates impacting a ground surface and with varying golf course conditions, making a divot while swinging a golf club. Further, it would be desirable to have a golf training apparatus having a hitting board that is resilient and movable between a starter configuration replicating a ground surface and a downward or compressed configuration when impacted by a golf club indicative of a golf club making a divot in the ground surface. In other words, the downward movement of the hitting board surface provides the golfer the feel of removing a loose piece of grass and dirt being dug out of the ground by the striking of a golf club to said hitting board e.g., making a divot. In addition, it would be desirable to have a golf training apparatus that is reconfigurable and interchangeable for replicating and/or imitating hard, soft, and wet playing surfaces.

SUMMARY OF THE INVENTION

The present invention relates to a compression based hitting board component as part a golf swing training aid device system. In preferred embodiments, the compression based hitting board, with a type of artificial golf turf attached to the hitting board surface, moves downward by way of a hinge mounted to the back of the hitting board component in between two back mounting boards at the rear of the device. This downward action is created by the compression springs, held in a compression spring holder, that connect into the slotted front of the hitting board component as well as the front bottom mounting board by a quick release center draw latch.

The device compresses when the hitting board is struck with a golf club during the action of taking a golf swing. In preferred embodiments the distinct compression units, (compression springs held in place by compression spring holders) are interchangeable and reconfigure the compression level at the front of the device according to the practice conditions chosen by the player. The distinct levels of the "compression units" imitate and/or replicate golf course grass ground surfaces including, but not limited to hard, soft, and wet ground playing surfaces. The device system has storage for two additional individual compression units in a spring box holder at the rear of the device.

In still other preferred embodiments, equal length stability boards attach to each side of the front bottom mounting board as well as each side of the back bottom mounting board. This allows for the device system to remain stationary and well balanced throughout the act of striking a golf club to the novel featured compressible hitting board component.

DESCRIPTION OF THE PREFERRED EMBODIMENT

Figure 1:
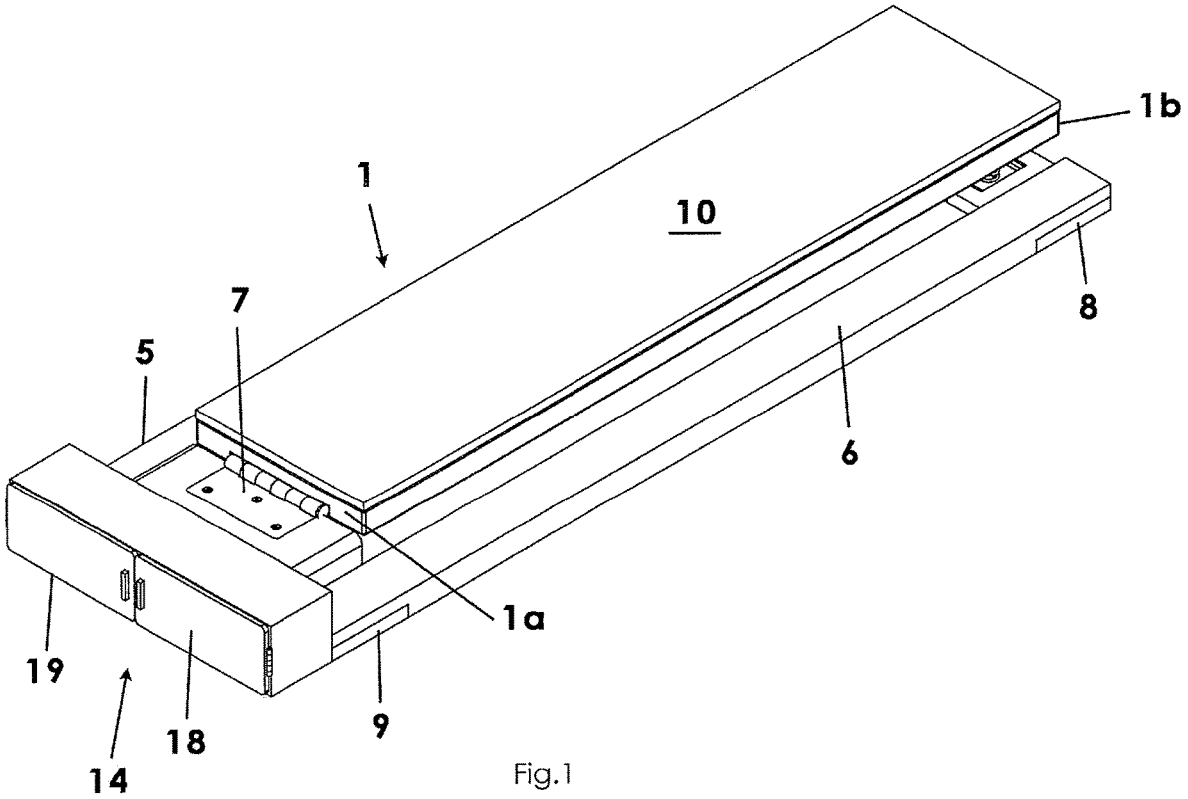
FIG. 1 is a perspective view of a golf swing training apparatus according to a preferred embodiment of the present invention.

A golf training apparatus according to a preferred embodiment of the present invention will now be described with reference to FIGS. 1 to 8 of the accompanying drawings. The golf training apparatus 100 includes a mounting framework 40, a hitting board 1 mounted to the mounting framework, a hinge 7, and at least one compression spring 2.

The golf training apparatus 100 includes a mounting framework 40 having a plurality of stability bars operative to provide stability and functionality to the hitting board 1 and related components that may be mounted to it as will be described below. More particularly, the mounting framework 40 may have a rectangular configuration as shown herein although others shape configurations may also work. Preferably, the mounting framework 40 includes a left side mounting member 6, a right side mounting member 5 that is spaced apart from and parallel to the left side mounting member 6, a front mounting member 8 connecting front ends of the right and left side mounting members 5, 6, respectively, and a back mounting member 9 connecting back ends of the right and left side mounting members 5, 6, respectively. Preferably, the front and back mounting members 8, 9 are parallel to one another and perpendicular to the right and left side mounting members 5, 6. Preferably, all of the mounting members described above are positioned in a unitary horizontal plane and, together, may define what would be called a picture frame configuration. In an embodiment, the mounting members may be constructed of composite wood although other woods, aluminum, carbon fiber, steel, fiberglass, titanium and other suitable materials may be used. It is understood that the dimensions of the framework 40 are exemplary but not limiting. It is also understood that the area proximate the front mounting member 8 may be referred to as a front end or front portion of the golf training apparatus 100 and the area proximate the back mounting member 9 may be referred to as a back end or back portion of the golf training apparatus 100.

Figure 5A:
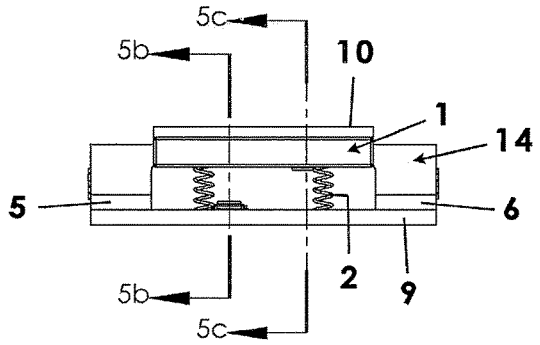
FIG. 5*a* is an end view of the golf swing training apparatus as in FIG. 1.
Figure 5B:
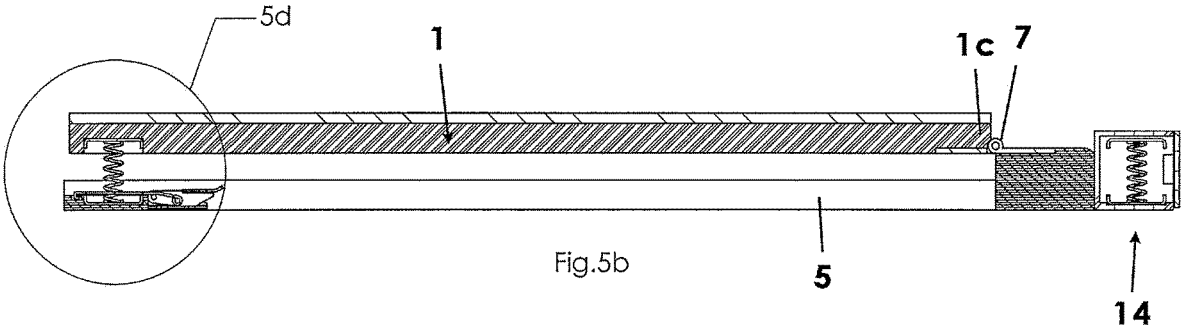
FIG. 5*b* is a sectional view taken along line 5*a*-5*a* of FIG. 5*a;*
Figure 5D:
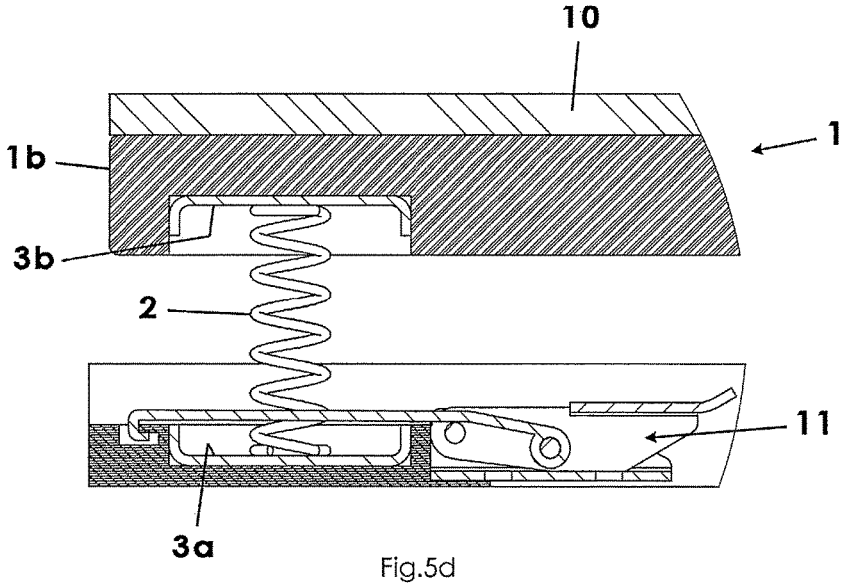
FIG. 5*d* is an isolated view on an enlarged scale taken from FIG. 5*b;*
Figure 5C:
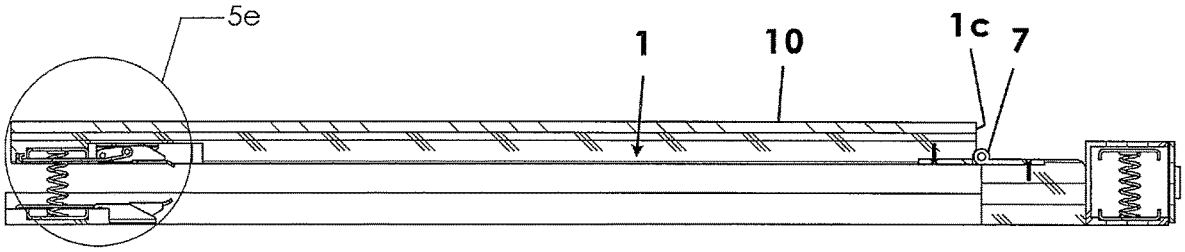
FIG. 5*c* is a sectional view taken along line 5*c*-5*c* of FIG. 5*a;*
Figure 5E:
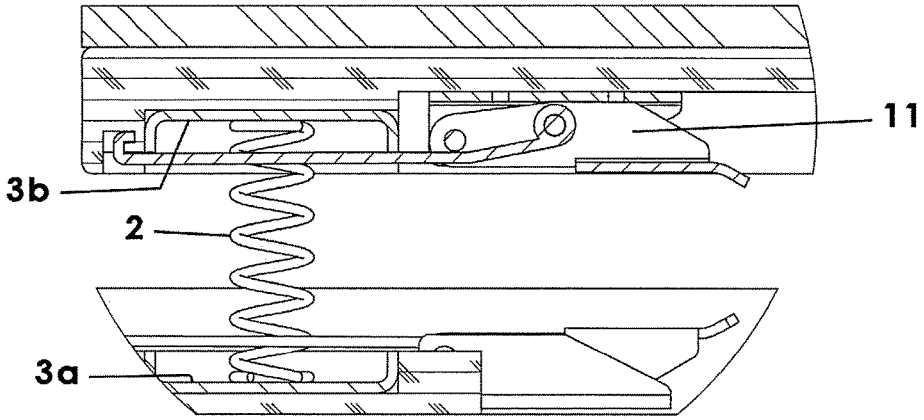
FIG. 5*e* is an isolated view on an enlarged scale taken from FIG. 5*d;*
Figure 6:
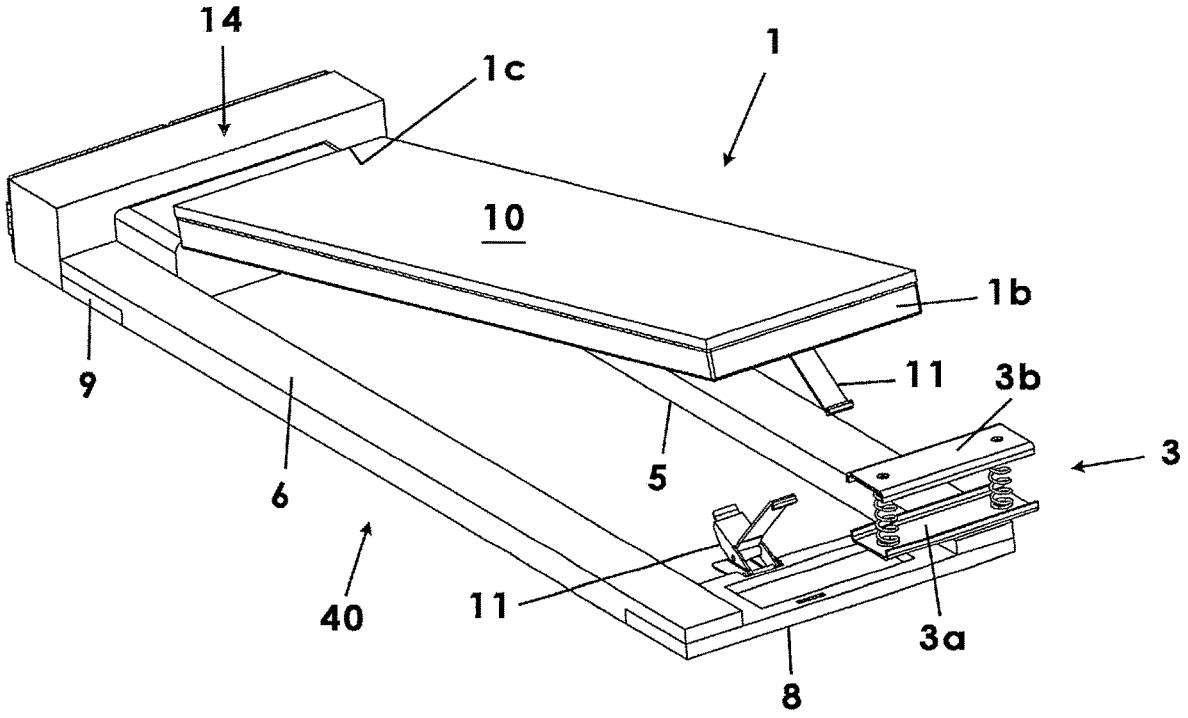
FIG. 6 is a perspective view from a reverse angle of the golf swing training apparatus as in FIG. 1, illustrating operation of center draw latches according to the present invention.

Further, the hitting board 1 is movably coupled to the front and back mounting members 4, 9 as described below. The hitting board 1 may include a proximal end 1*c* pivotally coupled to the back mounting member 9 with a fastener such as a hinge 7. More particularly the hinge 7 may have a first plate attached to an upper surface of the back mounting member 9 and a second plate attached to a bottom surface 1*a* of the hitting board 1, the hinge 7 being operative to allow the hitting board to be selectively moved downwardly as will be described below. Namely, the hitting board 1 may include a distal end 1*b* that is spaced apart and opposite the proximal end 1*c* and that is proximate to the front end. As shown in FIG. 5*d*, the distal end 1*b* is operatively coupled to the front mounting member 8 via a pair of compression springs 2 which are then coupled to the front mounting member 8. More particularly, the front mounting member 8 may be slotted or recessed such that the compression springs 2 extend upwardly between a top surface of the front mounting member 8 and the bottom surface 1*a* of the hitting board 1. The bottom surface 1*a* of the hitting board 1 may be similarly recessed. This structure allows the distal end 1*b* of the hitting board 1 to move downwardly and upwardly according to impact forces upon the hitting board 1, such as by impact from a golf club as will be described in further detail later. Compression springs, of course, are open-coil helical springs wound or constructed to oppose compression. Resilient members other than compression springs may also work, such as bar springs or the like. When a load is placed on a compression coil spring, making it shorter, it pushes back against the load and tries to get back to its original length. Compression springs offer resistance to linear compressing forces (push), and are in fact one of the most efficient energy storage devices available. This compressive technology replicates or imitates the resistance of a ground surface that a golf club encounters when "making a divot" during the action of hitting a golf ball on golf course grass. To simulate an actual golf experience even further, actual grass turf 10 may be attached or glued to the top surface of hitting board 1.

In another aspect, the compression springs 2 are interchangeable; in other words, a pair of compression springs may be swapped out and replaced with compression springs of another strength or weight capacity. More particularly, the golf training apparatus 100 includes a compression spring holder 3 in which the compression springs 2 are mounted and from which they extend upwardly. The compression spring holder 3 may include a lower wall 3*a* and an opposed upper wall 3*b* between which the compression springs 2 extend. The lower wall 3*a* may be nested in the slotted area of the bottom mounting board 4. The upper wall 3*b* may be in contact with the bottom surface 1*a* of the hitting board 1 such that a downward movement of the hitting board 1 causes the compression springs 2 to compress. The compression spring holder 3 is held in place by a fastener such as a center draw latch 11 that, when actuated, allows for a quick release and removal of the compression spring holder 3 and then replacement with a different compression spring holder 3 having compression springs having a different height and/or compressive strength. This structure allows the compression spring holder 3 to be interchanged quickly and easily. The compression spring holder 3 may be comprised of aluminum, carbon fiber, steel, fiberglass, titanium, or any other suitable material that is preferably lightweight yet strong enough to support varying degrees of impact resistance and weight.

Figure 2:
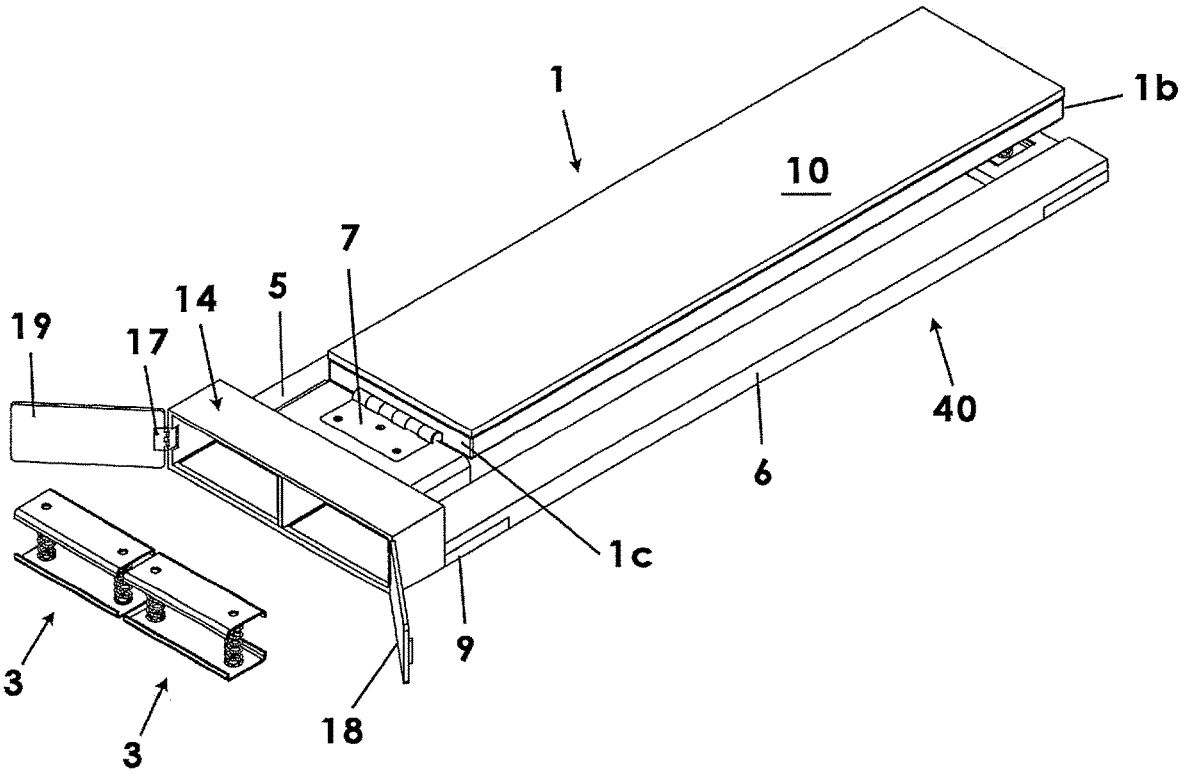
FIG. 2 is a partially exploded view of the golf swing training apparatus as in FIG. 1, illustrated with the doors of a spring storage box in the open configuration and additional spring packs exploded.
Figure 3A:
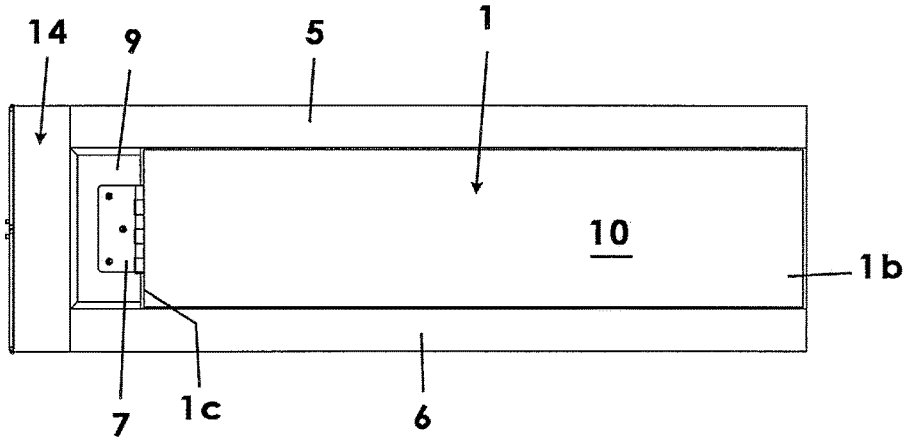
FIG. 3*a* is a top view of the golf swing training apparatus as in FIG. 1.
Figure 3B:
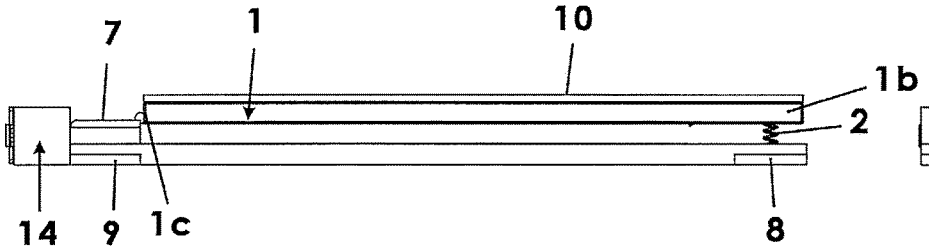
FIG. 3*b* is a side view of the golf swing training apparatus as in FIG. 3*a;*
Figure 3C:
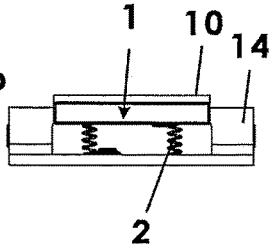
FIG. 3*c* is an end view of the golf swing training apparatus as in FIG. 3*a;*
Figure 4A:
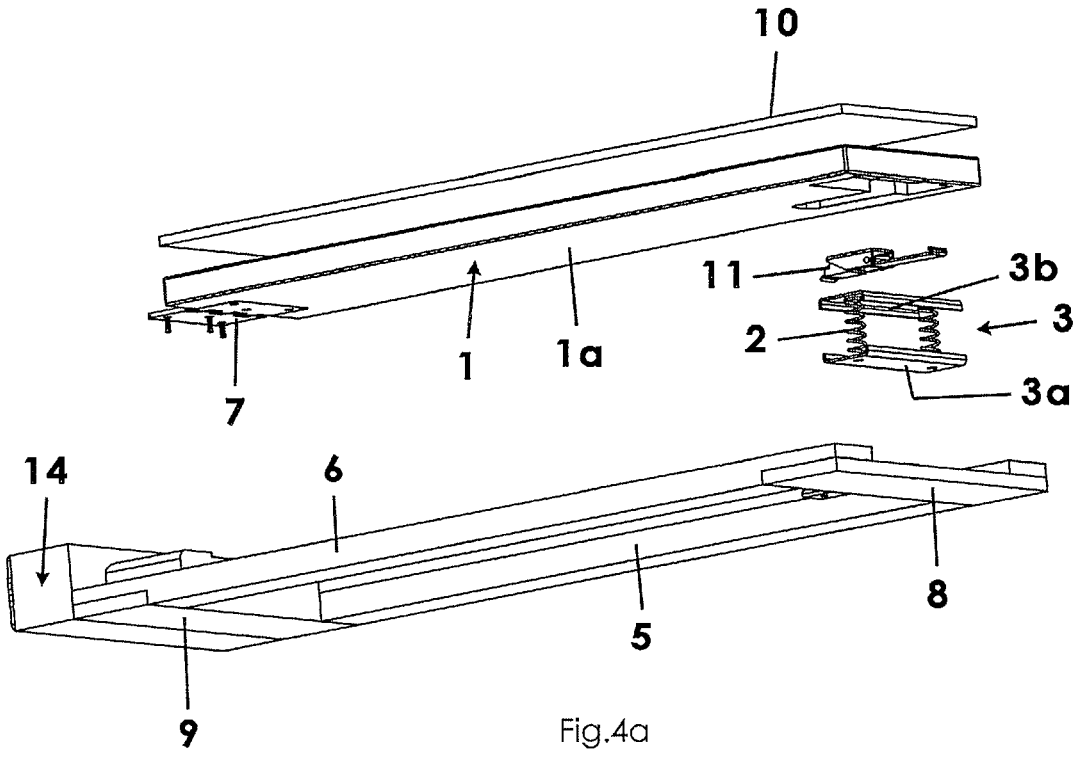
FIG. 4*a* is an exploded view of the golf swing training apparatus as in FIG. 1.
Figure 4B:
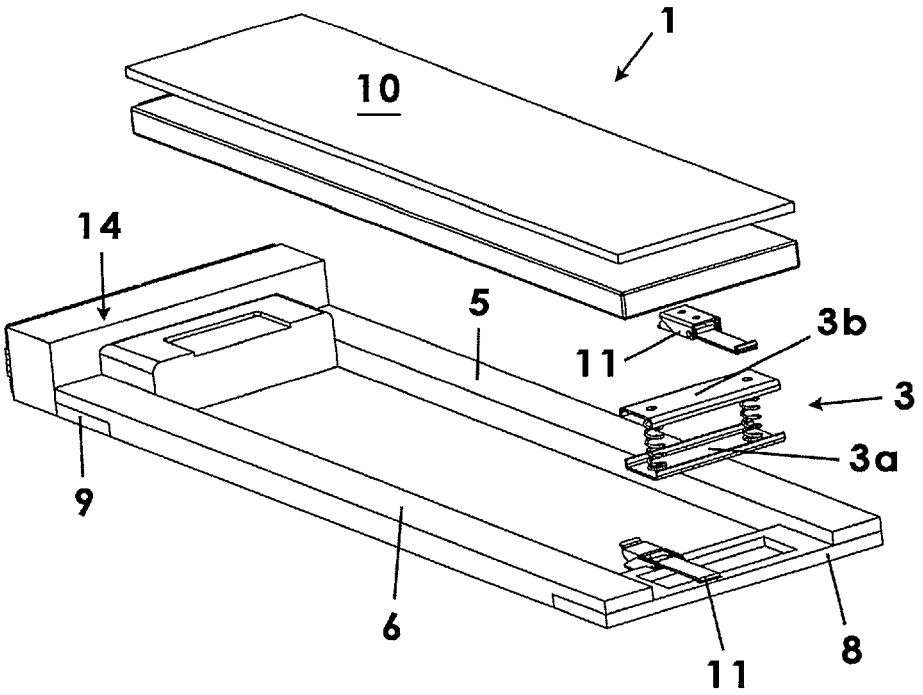
FIG. 4*b* is another exploded view taken from another angle of the golf swing training apparatus as in FIG. 4*a;*

In an embodiment, the golf swing training apparatus 100 may include a compression spring storage box 14 coupled to the framework 40 and defining an interior area in which at least two additional spring holders 3 may be removably stored (FIG. 2). As the name implies, the compression spring box holder 14 includes at least one and, preferably, a pair of doors 18, 19 each being pivotally movable, such as via miniature hinges 17, between open configurations allowing access to compression spring holders 3 housed in the interior space, respectively, and closed configurations not allowing access to the compression spring holders 3, respectively. The doors 18, 19 may be releasably secured in the closed configurations by magnetic attraction. More particularly, each door 18, 19 may include a magnetic plate and the compression spring box holder 14 may include a pair of magnetic catches complementary to respective magnetic plates for magnetically holding the doors in the closed configurations. In use, this embodiment provides enhanced security and stability by protecting compression spring holders 3 behind closed doors except when being interchanged and also provides an additional pair of compression springs 2. In an optional embodiment and as shown in FIGS. 7 and 8, the golf swing training apparatus 100 may include a second pair of compression spring holders 3 and associated compression springs 2.

Figure 7:
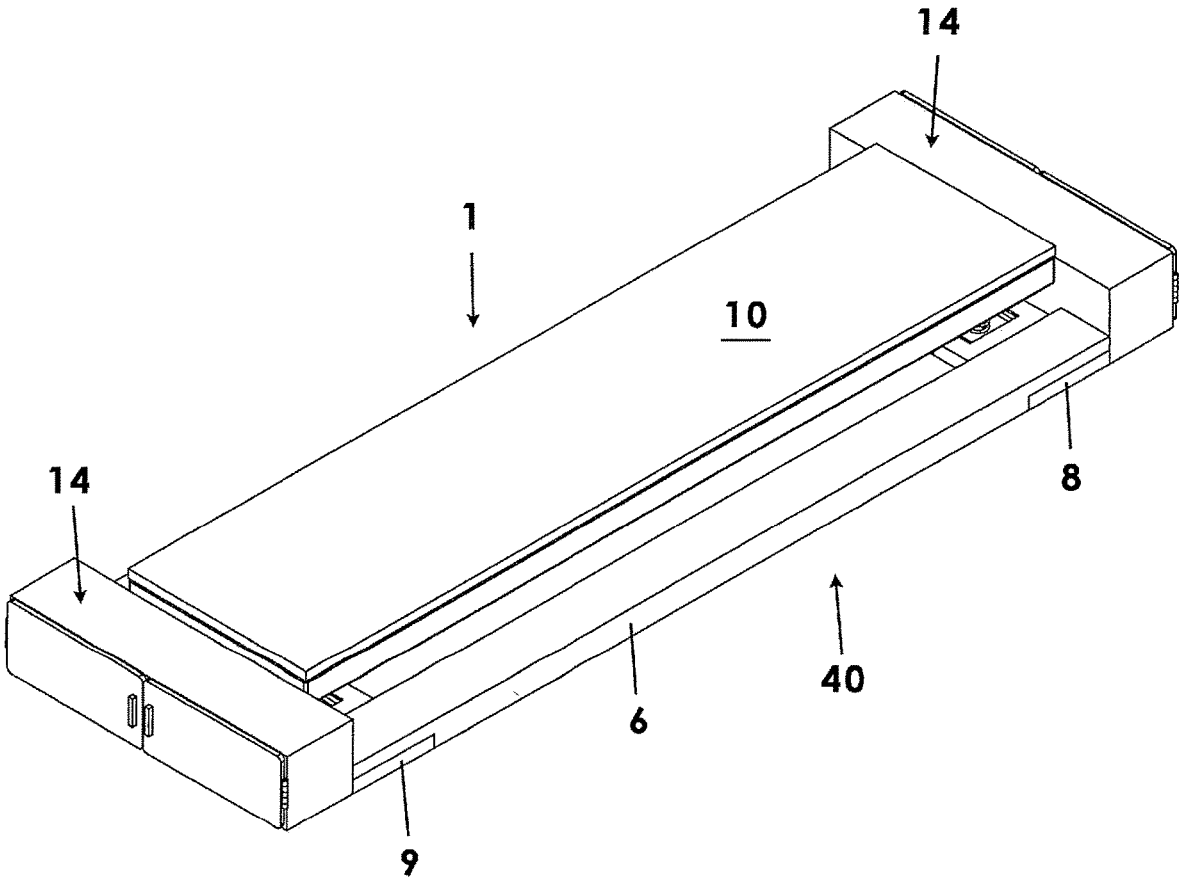
FIG. 7 is a perspective view of a golf swing training apparatus according to another embodiment of the present invention.
Figure 8:
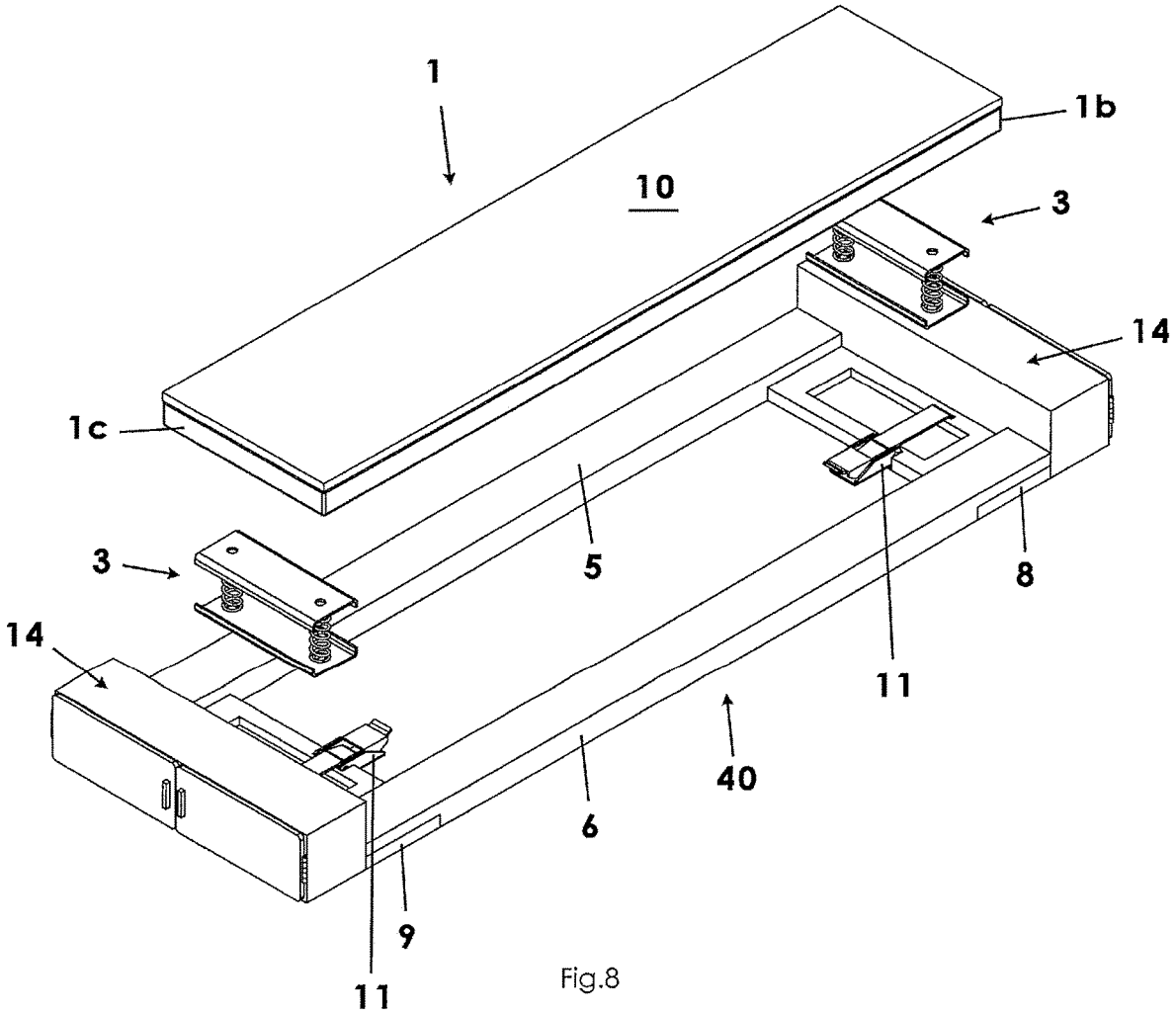
FIG. 8 is an exploded view of the golf swing training apparatus as in FIG. 7.

A golf swing training apparatus 100 according to an alternative embodiment is shown in FIGS. 7 and 8 and has a construction that is substantially similar to the apparatus described above except as noted below. In this embodiment, a compression spring holder 3 and, therefore, one or more compression springs 2 are positioned immediately under both/opposite ends of the hitting board 1. There is no hinge in this embodiment. Specifically, removable and interchangeable spring holders 3 are releasably positioned atop end walls 8 and 9. In addition, a spring storage box 14 may be mounted to both ends of the framework 40 so as to store additional spring holders associated with the two sets of compression springs and associated holders. In use, when an impact force is received by the hitting board 1, the hitting board 1 is moved downwardly to place an equal load upon each of the opposed compression spring holders 3. Accordingly, the hitting board 1 maintains a level orientation when struck by a golf club and so as to give a more realistic feeling of making a divot prior to or after striking the ball.

In use, a golf ball may be positioned atop the hitting board and a user may swing a golf club so as to impact the golf ball. To make a good swing, the golf club will impact the hitting board 1 slightly before or when impacting the golf ball and, preferably, will dig out a so-called divot under the ball. The divot is simulated by the present invention in that the hitting board is capable of moving downwardly when impacted by the golf swing, the downward movement causing the compression springs 2 to compress and the hinge 7 to pivot. Then, when the impact force is removed, i.e., during a swing follow-through, the compression springs 2 return to their uncompressed state and the hitting board 1 is returned to its upward and normal configuration.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention.

The invention claimed is:

1. A golf swing training apparatus that uses compressive forces to simulate making a divot adjacent a golf ball when swinging a golf club, said golf training apparatus, comprising:

a framework having a front mounting member and a back mounting member opposite and parallel to the front mounting member, said framework including a left side mounting member extending between said front and back mounting members and a right side mounting member opposite and parallel to said left side member extending between said front and back mounting members;

a hitting board having a proximal end pivotally coupled to the back mounting member with a hinge and having a distal end opposite said proximal end, said hitting board being pivotally movable by operation of said hinge;

a compression spring extending between a top surface of the front mounting member and a bottom surface of the hitting board such that said compression spring is compressed when said hitting board is urged downwardly by an impact force and is resilient to decompress when the impact force is removed;

a plurality of compression spring holders each having a lower wall and an upper wall displaced from and parallel to the lower wall;

wherein said compression spring extends between said lower wall and said upper wall of a respective compression spring holder;

wherein said lower wall and said upper wall of said respective spring holder are removably nested in said recessed area of said front mounting member and said recessed area of said hitting board, respectively;

a compression spring storage box having a plurality of walls that together define an interior area and an open front for receiving said plurality of compression spring holders into said interior area; and a door pivotally coupled to an outer edge of said compression spring storage box and pivotally movable between an open configuration displaced from said open front for allowing access to said interior space and a closed configuration covering said open side for preventing access to said interior space.

2. The golf swing training apparatus as in claim 1, wherein said hinge includes a first plate coupled to an upper surface of the back mounting member and a second plate coupled to a bottom surface of the hitting board and a barrel pivotally coupling together said first and second plates so that the hitting board is selectively movable upwardly and downwardly relative to an axis defined by said barrel.

3. The golf swing training apparatus as in claim 1, wherein:

said top surface of the front mounting member defines a recessed area;

said bottom surface of the hitting board adjacent said distal end defines a recessed area; and said compression spring extends between said recessed area of said front mounting member and said recessed area of said bottom surface of said hitting board.

4. The golf swing training apparatus as in claim 1, wherein said respective spring holder is releasably attached to said front mounting member with a quick release fastener.

5. The golf swing training apparatus as in claim 4, wherein said quick release fastener is a center draw latch.

6. The golf swing training apparatus as in claim 1, wherein said each compression spring holder includes a compression spring having a height and compressive strength that is different than any other compression spring associated with said plurality of compression spring holders.

7. The golf swing training apparatus as in claim 1, wherein said compression spring includes a pair of open-coil helical springs that are wound to oppose and resist compression when a load is applied thereto and that are resilient to return to an original length when the load is removed.

8. The golf swing training apparatus as in claim 1, wherein:

said compression spring storage box includes a magnetic catch; and said door has a magnetic plate adjacent a free edge thereof that is magnetically coupled to said magnetic catch, respectively, when said door is at said closed configuration.

9. A golf swing training apparatus that uses compressive forces to simulate making a divot adjacent a golf ball when swinging a golf club, said golf training apparatus, comprising:

a framework having a front mounting member and a back mounting member opposite and parallel to the front mounting member, said framework including a left side mounting member extending between said front and back mounting members and a right side mounting member opposite and parallel to said left side member extending between said front and back mounting members;

a hitting board having a proximal end pivotally coupled to the back mounting member with a hinge and having a distal end opposite said proximal end, said hitting board being pivotally movable by operation of said hinge, said hinge having a first plate coupled to an upper surface of the back mounting member and a second plate coupled to a bottom surface of the hitting board and a barrel pivotally coupling together said first and second plates so that the hitting board is selectively movable upwardly and downwardly relative to an axis defined by said barrel;

a compression spring extending between a top surface of the front mounting member and the bottom surface of the hitting board such that said compression spring is compressed when said hitting board is urged downwardly by an impact force and is resilient to decompress when the impact force is removed;

wherein:

said top surface of the front mounting member defines a recessed area; and said bottom surface of the hitting board adjacent said distal end defines a recessed area;

said compression spring extends between said recessed area of said front mounting member and said recessed area of said hitting board;

said golf swing training apparatus, further comprising:

a plurality of compression spring holders each having a lower wall and an upper wall displaced from and parallel to the lower wall;

wherein said compression spring extends between said lower wall and said upper wall of a respective compression spring holder;

wherein said lower wall and said upper wall of said respective spring holder are removably nested in said recessed area of said front mounting member and said recessed area of said hitting board, respectively;

a compression spring storage box having a plurality of walls that together define an interior area and an open front for receiving said plurality of compression spring holders into said interior area; and a door pivotally coupled to an outer edge of said compression spring storage box and pivotally movable between an open configuration displaced from said open front for allowing access to said interior space and a closed configuration covering said open side for preventing access to said interior space.

10. The golf swing training apparatus as in claim 9, wherein said respective spring holder is releasably attached to said front mounting member with a quick release fastener.

11. The golf swing training apparatus as in claim 10, wherein said quick release fastener is a center draw latch.

12. The golf swing training apparatus as in claim 9, wherein said each compression spring holder includes a compression spring having a height and compressive strength that is different than any other compression spring associated with said plurality of compression spring holders.

13. The golf swing training apparatus as in claim 9, wherein:

said compression spring storage box includes a magnetic catch; and said door has a magnetic plate adjacent a free edge thereof that is magnetically coupled to said magnetic catch, respectively, when said door is at said closed configuration.

14. A golf swing training apparatus that uses compressive forces to simulate making a divot adjacent a golf ball when swinging a golf club, said golf training apparatus, comprising:

a framework having a front mounting member and a back mounting member opposite and parallel to the front mounting member, said framework including a left side mounting member extending between said front and back mounting members and a right side mounting member opposite and parallel to said left side member extending between said front and back mounting members;

a hitting board having a proximal end operatively mounted to the back mounting member and having a distal end opposite said proximal end that is operatively mounted to the front mounting member, said hitting board being vertically movable when actuated by receiving a downward load;

a first compression spring extending between a top surface of the front mounting member and a bottom surface of the hitting board such that said first compression spring is compressed when said distal end of said hitting board is urged downwardly by an the downward load received upon said hitting board and is resilient to decompress when the downward load is removed; and a second compression spring extending between a top surface of the front mounting member and the bottom surface of the hitting board such that said second compression spring is compressed when said proximal end of said hitting board is urged downwardly by said downward load and is resilient to decompress when the impact force is removed;

a plurality of compression spring holders each having a lower wall and an upper wall displaced from and parallel to the lower wall;

wherein said first and second compression springs extend between said lower wall and said upper wall of a respective compression spring holder, respectively;

wherein said lower wall and said upper wall of said respective spring holder are removably nested between said framework and said bottom surface of said hitting board, respectively;

a compression spring storage box having a plurality of walls that together define an interior area and an open front for receiving said plurality of compression spring holders into said interior area; and a door pivotally coupled to an outer edge of said compression spring storage box and pivotally movable between an open configuration displaced from said open front for allowing access to said interior space and a closed configuration covering said open side for preventing access to said interior space.

* * * * *